US012209770B2

(12) United States Patent
Zhou et al.

(10) Patent No.: US 12,209,770 B2
(45) Date of Patent: Jan. 28, 2025

(54) UNPOWERED COWL WITH ADJUSTABLE FAN BLADES AND WASTE HEAT RECOVERY SYSTEM FOR COOKING FUMES

(71) Applicant: INNOVATION RESEARCH INSTITUTE OF ZHEJIANG UNIVERSITY OF TECHNOLOGY SHENGZHOU, Zhejiang (CN)

(72) Inventors: Shuiqing Zhou, Zhejiang (CN); Xinhan Huang, Zhejiang (CN); Xing He, Zhejiang (CN); Zengliang Gao, Zhejiang (CN); Lijian Guo, Zhejiang (CN)

(73) Assignee: INNOVATION RESEARCH INSTITUTE OF ZHEJIANG UNIVERSITY OF TECHNOLOGY SHENGZHOU, Shaoxing (CN)

( * ) Notice: Subject to any disclaimer, the term of this patent is extended or adjusted under 35 U.S.C. 154(b) by 0 days.

(21) Appl. No.: 18/797,536

(22) Filed: Aug. 8, 2024

(65) Prior Publication Data

US 2024/0426493 A1 Dec. 26, 2024

Related U.S. Application Data

(63) Continuation of application No. PCT/CN2024/090376, filed on Apr. 28, 2024.

(30) Foreign Application Priority Data

Jun. 25, 2023 (CN) ..... 202310746924.5

(51) Int. Cl.
*F24F 7/04* (2006.01)
*F24F 11/30* (2018.01)
(Continued)

(52) U.S. Cl.
CPC ..... *F24F 7/04* (2013.01); *F24F 11/30* (2018.01); *F24F 12/00* (2013.01); *F24F 2140/10* (2018.01)

(58) Field of Classification Search
CPC .... F24F 7/04; F24F 11/30; F24F 12/00; F24F 2140/10; F24F 1/0097; F24F 1/0378;
(Continued)

(56) References Cited

U.S. PATENT DOCUMENTS 3,267,833 A * 8/1966 Artis ..... F23L 17/10 384/282
4,115,032 A * 9/1978 Lange ..... F03D 3/062 416/197 A
(Continued)

FOREIGN PATENT DOCUMENTS

CN 201972962 U 9/2011
CN 207849641 U 9/2018
(Continued)

*Primary Examiner* — Michael G Hoang
*Assistant Examiner* — Ryan L Faulkner

(57) ABSTRACT

An unpowered cowl with adjustable fan blades and a waste heat recovery system for cooking fumes include a cowl body, lifting mechanisms, and a pressure sensor. The cowl body includes a top cap, a bottom ring, and the fan blades disposed between the top cap and the bottom ring. The pressure sensor is disposed on an inner wall of the top cap. An upper end of each of the fan blades is disposed above the top cap and slightly exceeds an outer edge of the top cap. The lifting mechanisms are annularly disposed on the top cap. The lifting mechanisms include lifting plates, electric pushing rods, and lifting shafts. The electric pushing rods are fixed on the top cap. The lifting shafts are connected to the fan blades. The electric pushing rods and the pressure sensor are electrically connected to a control box.

10 Claims, 5 Drawing Sheets

(51) Int. Cl.
*F24F 12/00* (2006.01)
*F24F 140/10* (2018.01)

(58) Field of Classification Search
CPC ..... F24F 2007/001; F24F 7/02; F24F 7/025; F24F 7/06; F24F 7/065; F24F 7/08; F24F 7/10; F24F 12/001; F24F 2012/008
USPC ..... 454/242
See application file for complete search history.

(56) References Cited

U.S. PATENT DOCUMENTS 4,501,389 A * 2/1985 Kolt ..... F24F 13/1426 236/49.5
4,548,137 A 10/1985 Lane
4,582,250 A * 4/1986 Kolt ..... F24F 11/76 236/49.5
4,648,312 A * 3/1987 Schad ..... F23L 17/005 454/344
4,831,921 A * 5/1989 Potter ..... F24F 7/02 454/341
5,326,313 A * 7/1994 Miniat ..... F23L 17/10 454/18
6,302,778 B1 * 10/2001 Andrews ..... F24F 7/025 454/16
6,352,473 B1 * 3/2002 Clark ..... F23L 17/10 454/18
6,431,973 B1 * 8/2002 Tsung ..... F24F 7/025 454/18
2011/0017200 A1 * 1/2011 Zwern ..... F24S 23/77 126/621

FOREIGN PATENT DOCUMENTS

CN 208057519 U 11/2018
CN 211288130 U 8/2020
CN 212774854 U 3/2021
CN 113834085 A 12/2021
CN 215637791 U 1/2022
CN 116791855 A 9/2023
KR 20130074335 A 7/2013

* cited by examiner

UNPOWERED COWL WITH ADJUSTABLE FAN BLADES AND WASTE HEAT RECOVERY SYSTEM FOR COOKING FUMES

TECHNICAL FIELD

The present disclosure relates to a field of fume exhaust equipment for common flues, and in particular to an unpowered cowl with adjustable fan blades and a waste heat recovery system for cooking fumes.

BACKGROUND

With rapid development of China's economy, buildings are built higher and higher. A modern residential building typically adopts a high-rise design structure with a common flue, and an exhaust pipe of each of range hoods is connected to the common flue, so that cooking fumes are exhausted to an outside. A process of exhausting the cooking fumes to the outside mainly relies on mechanical push of the range hoods to exhaust the cooking fumes upward. The cooking fumes in middle and low-rise dwellings are subject to greater on-way resistance during an exhausting process, which is not conducive to proper exhausting.

An unpowered cowl is a device that utilizes a principle of indoor and outdoor air convection, using natural wind to drive a turbine of a fan to rotate, accelerating air flow in any horizontal direction and converting the air flow in any horizontal direction into a vertical air flow moving upwards to enhance indoor ventilation and exchange of air. The unpowered cowl has advantages of easy installation, no need for additional power supply, and long-term operation, so the unpowered cowl is widely used as a power source for common flues to direct an external exhausting of the cooking fumes. However, residents tend to cook at similar times, leading to peak periods when a large amount of cooking fumes accumulates in the common flue as the range hoods exhaust the cooking fumes. Currently, fan blades of a conventional unpowered cowl are fixed, making an exhausting volume of the cooking fumes (at a certain wind speed) and an exhausting direction fixed, which does not effectively handle situations where there is a large volume of cooking fumes to be exhausted and affects exhausting efficiency of the cooking fumes. Further, when the conventional unpowered cowl does not exhaust the cooking fumes, the conventional unpowered cowl still needs to take on functions of air exchange and rain protection. If an opening degree of the fan blades increases for exhausting, rain and dirt from the outside easily fall into the common flue from the conventional unpowered cowl. In addition, the cooking fumes exhausted from the conventional unpowered cowl contains a large amount of waste heat, if the cooking fumes are exhausted directly, energy waste is cased.

SUMMARY

The present disclosure provides an unpowered cowl with adjustable fan blades to solve technical problems in the prior art. In the unpowered cowl with the adjustable fan blades of the present disclosure, fan blades thereof are connected to a top cap thereof through lifting mechanisms thereof. Further, a pressure sensor thereof is disposed in the top cap. When the pressure sensor detects that a pressure inside the unpowered cowl is too large, it is determined that an amount of cooking fumes exhausted in a common flue is large, and the lifting mechanisms are driven to work. The lifting mechanisms lift the fan blades to increase an opening degree of the fan blades, so that an exhaust amount of the cooking fumes exhausted by the unpowered cowl increases, and fume exhaust efficiency improves. In addition, the present disclosure further provides a waste heat recovery system for cooking fumes including the unpowered cowl and thermoelectric generators, which is configured to absorb the waste heat of the cooking fumes and converting the waste heat into electric energy, thereby avoiding energy waste. Furthermore, the waste heat recovery system for the cooking fumes increases the exhaust amount of the cooking fumes by adjusting the opening degree of the fan blades of the unpowered cowl, so as to enhance convection heat exchange, so that the thermoelectric generators better absorb the waste heat of the cooking fumes, thereby recycling the cooking fumes.

The unpowered cowl with the adjustable fan blades comprises a cowl body, and a base. The cowl body comprises a top cap, a bottom ring, and fan blades closely disposed between the top cap and the bottom ring. The base comprises a variable-angle pipe neck and a waterproof base fixedly connected to the variable-angle pipe neck. A screw and an upper support are disposed in the cowl body. A lower support is disposed in the base. An upper end of the screw is rotatably connected to the top cap. A lower end of the screw passes through a center of the upper support. The lower end of the screw is fixedly connected to the lower support.

The unpowered cowl further comprises lifting mechanisms and a pressure sensor. The pressure sensor is disposed on an inner wall of the top cap. An upper end of each of the fan blades is disposed above the top cap and slightly exceeds an outer edge of the top cap. A quantity of the lifting mechanisms is corresponding to a quantity of the fan blades. The lifting mechanisms are annularly disposed on the top cap. The lifting mechanisms comprise lifting plates, electric pushing rods, and lifting shafts. Each of the electric pushing rods and a corresponding one of the lifting shafts are respectively disposed on two ends of each of the lifting plates. The electric pushing rods are fixed on the inner wall of the top cap. Each of the lifting shafts is connected to a corresponding one of the fan blades. The electric pushing rods and the pressure sensor are electrically connected to a control box. The control box is disposed on an outer wall of the top cap.

Compared with the prior art, in the unpowered cowl of the present disclosure, the fan blades are connected to the top cap thereof through the lifting mechanisms. The pressure sensor is disposed in the top cap. The pressure sensor is configured to detect a pressure inside the unpowered cowl and send a pressure value to the control box.

When the pressure value is greater than a predetermined value, the control box determines that an amount of cooking fumes in the common flue is large, and the control box controls the lifting mechanisms to work. Specifically, each of the electric pushing rods pushes a first end of each of the lifting plates to move downwards, so that a second end of each of the lifting plates tilts to drive each of the lifting shafts to move upwards to lift each of the fan blades, thereby increasing the opening degree of the fan blades, increasing the exhaust amount of the cooking fumes exhausted from the unpowered cowl, and improving exhaust efficiency. In addition, the upper end of each of the fan blades is disposed above the top cap, and an end portion of the upper end of each of the fan blades slightly exceeds the outer edge of the top cap. When the fan blades are lifted, the end portion of the upper end of each of the fan blades contacts the top cap, so that there is no gap between the fan blades and the top cap after the fan blades are completely lifted, and rain and external dirt are prevented from falling into the common flue.

Optionally, in the unpowered cowl, an angle between each of the lifting shafts and a corresponding one of the lifting plates is 100°-145°. Therefore, when the lifting mechanisms work, the lifting shafts obliquely moves upwards, and an angle between each of the lifting shafts and a vertical plane is between 10°-45°. When the lifting plates are subjected to downward pressure, the lifting shafts well lift the fan blades, thereby increasing the opening degree of the fan blades.

Furthermore, each of the lifting plates is in a shape of a water drop. A large end of each of the lifting plates is connected to a corresponding one of the electric pushing rods, and a small end of each of the lifting plates is connected to a corresponding one of the lifting shafts. Therefore, when the electric pushing rods push the lifting plates downwards, the lifting shafts are easier to be driven to move upwards.

Optionally, in the unpowered cowl, two sides of the upper end of each of the fan blades are connected to two adjacent fan blades through corresponding two of the lifting shafts. Therefore, it is ensured that an increased opening degree of each of the fan blades is relatively uniform, so that the cooking fumes are uniformly discharged from the unpowered cowl.

Furthermore, each of the lifting shafts is cylindrical and comprises internal threads. Each of the lifting shafts is connected to a corresponding one of the fan blades through a bolt.

Optionally, in the unpowered cowl, the unpowered cowl further comprises rivets. Two sides of a lower end of each of the fan blades are respectively connected to two adjacent fan blades through corresponding two of the rivets, and the rivets are fixed on the bottom ring. Therefore, a structure of the unpowered cowl is simple, and the unpowered cowl is easy to assemble.

Optionally, in the unpowered cowl, the control box comprises a controller and a power module. The power module is electrically connected to a solar battery. The power module supplies power to the controller, the electric pushing rods and the pressure sensor. When the unpowered cowl is used independently, a solar battery is disposed on the top cap and is electrically connected to the power module. The solar battery is configured to convert solar energy into electric energy and store the electric energy, and the solar battery is further configured to provide the electric energy for the controller, the electric pushing rods, and the pressure sensor, so that use of mains supply is reduced to save energy.

The waste heat recovery system for the cooking fumes comprises the unpowered cowl mentioned above, a common flue, and thermoelectric generators.

The unpowered cowl is disposed at the common flue. The thermoelectric generators are disposed around the unpowered cowl at intervals along a circumferential direction thereof. A hot end of each of the thermoelectric generators is disposed opposite to the fan blades, and an output end of each of the thermoelectric generators is connected to a storage battery.

Compared with the prior art, the waste heat recovery system for the cooking fumes of the present disclosure is configured to absorb and convert waste heat of the cooking fume in the common flue into the electric energy, and store the electric energy in the storage battery. The waste heat recovery system for the cooking fumes is configured to supply power to small devices in a building (for example, various measurement devices, control valves, control switches, sensors, etc.), thereby avoiding energy waste. Moreover, the thermoelectric generators are disposed at intervals in the circumferential direction of the unpowered cowl, so that the waste heat of the cooking fumes is fully recycled. When the waste heat recovery system for the cooking fumes works, the exhaust amount of the cooking fumes is increased by adjusting the opening degree of the fan blades, and the exhaust direction of the cooking fumes is changed, so that the cooking fumes better impact the hot end of each of the thermoelectric generators, efficiency of obtaining the waste heat of the cooking fumes by the thermoelectric generators is enhanced, and waste heat utilization rate is improved. In addition, the unpowered cowl is a metal structure, and has a higher temperature when exposed to a top layer of a building in high-temperature weather. The unpowered cowl transfers heat to the cooking fumes by convection heat exchange in a rotating process. When the opening degree of the fan blades of the unpowered cowl increases, the exhaust amount of the cooking fumes increases, so that convection heat exchange is enhanced, and heat of the unpowered cowl itself is better transferred to the cooking fumes.

Optionally, in the waste heat recovery system for the cooking fumes, the control box is connected to the storage battery through a conductive slip ring. Therefore, the control box is directly powered by the storage battery without providing additional independent power sources, thereby simplifying a structure of the waste heat recovery system for the cooking fumes and making an installation of the waste heat recovery system for the cooking fumes convenient.

Optionally, in the waste heat recovery system for the cooking fumes, an ultraviolet lamp is disposed on an inner wall of an outlet of the common flue, and the ultraviolet lamp is electrically connected to the storage battery. The ultraviolet lamp is configured to disinfect and purify the cooking fumes in the common flue, so that exhausted cooking fumes are more environmentally friendly. After the exhausted cooking fumes not absorbed by the thermoelectric generators are exhausted into atmosphere, environment is not polluted.

Figure 1:
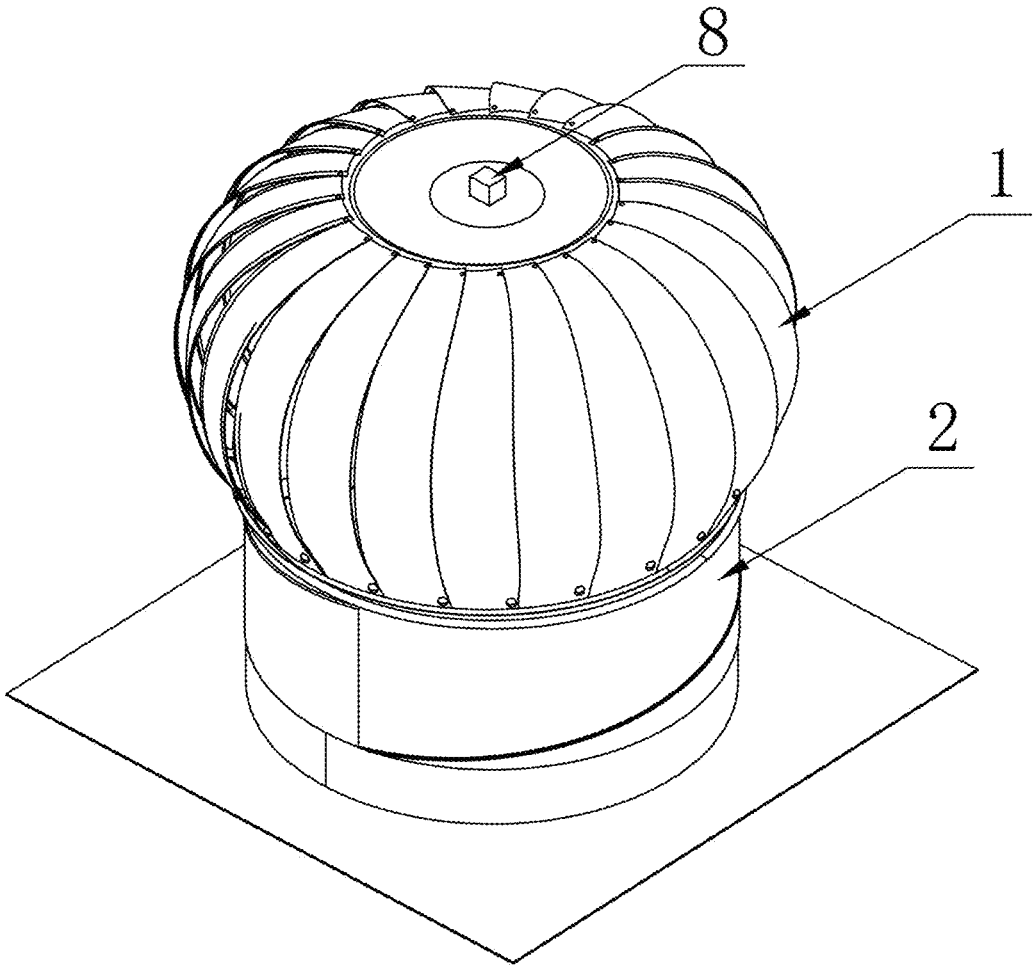
FIG. 1 is a structural schematic diagram of an unpowered cowl with adjustable fan blades of the present disclosure.
Figure 2:
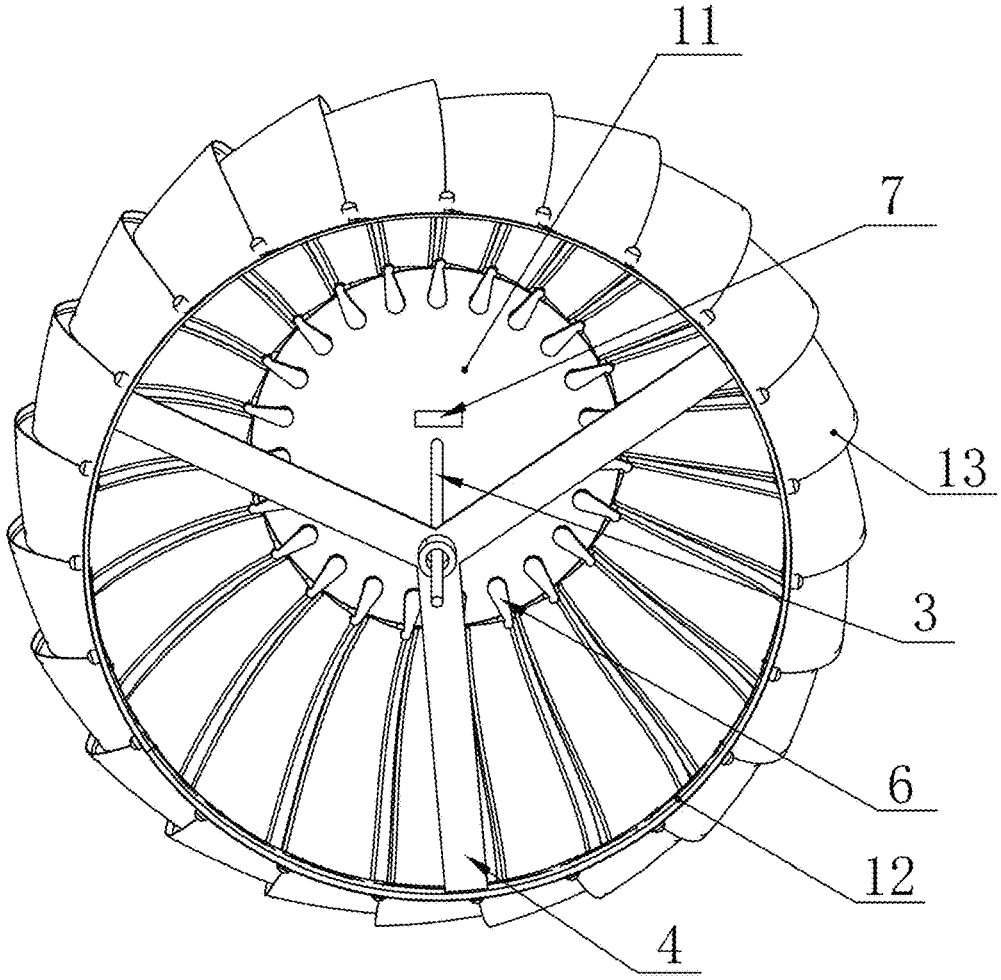
FIG. 2 is a structural schematic diagram of a cowl body of the present disclosure.
Figure 3:
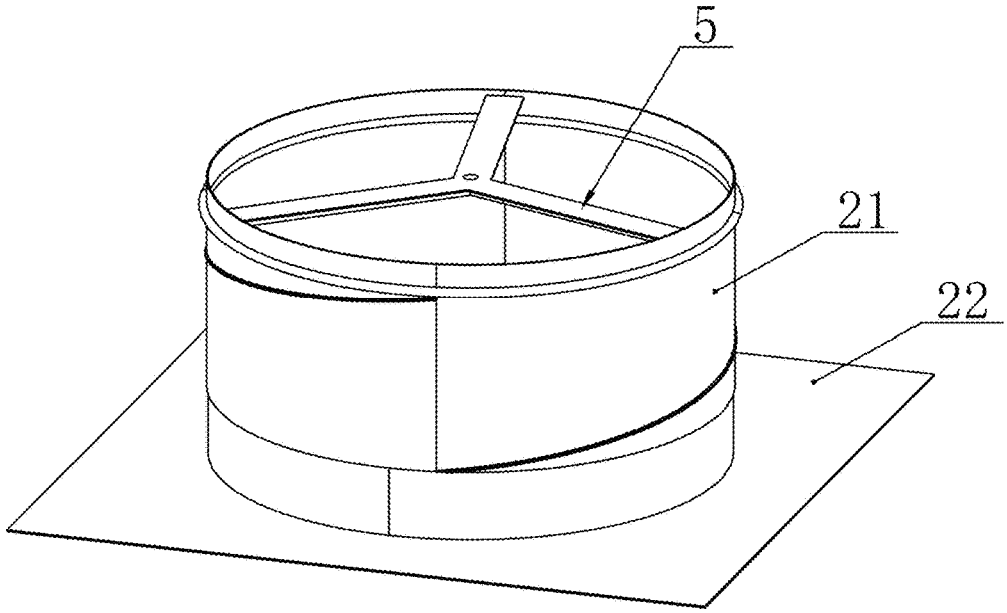
FIG. 3 is a structural schematic diagram of a base of the present disclosure.
Figure 4:
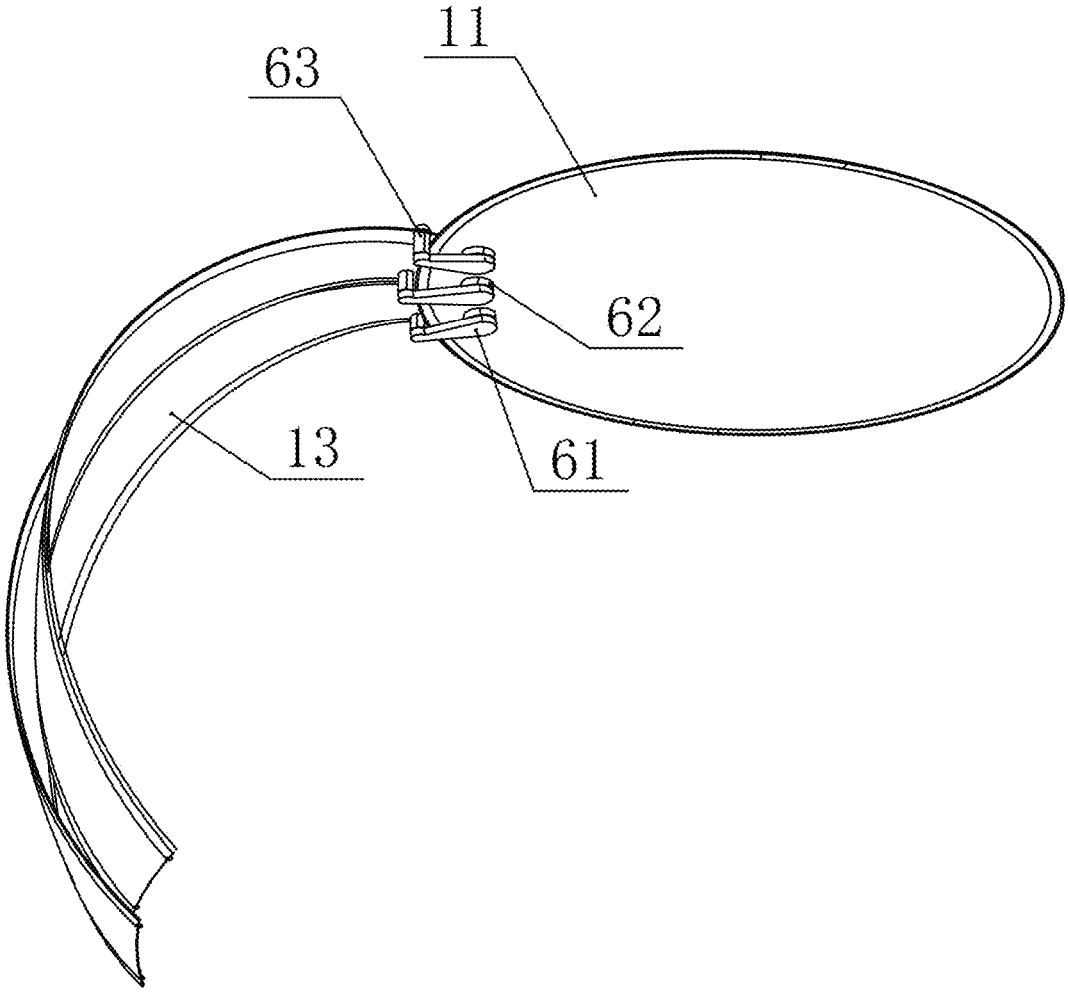
FIG. 4 is a structural schematic diagram of a top cap assembled with fan blades of the present disclosure.
Figure 5:
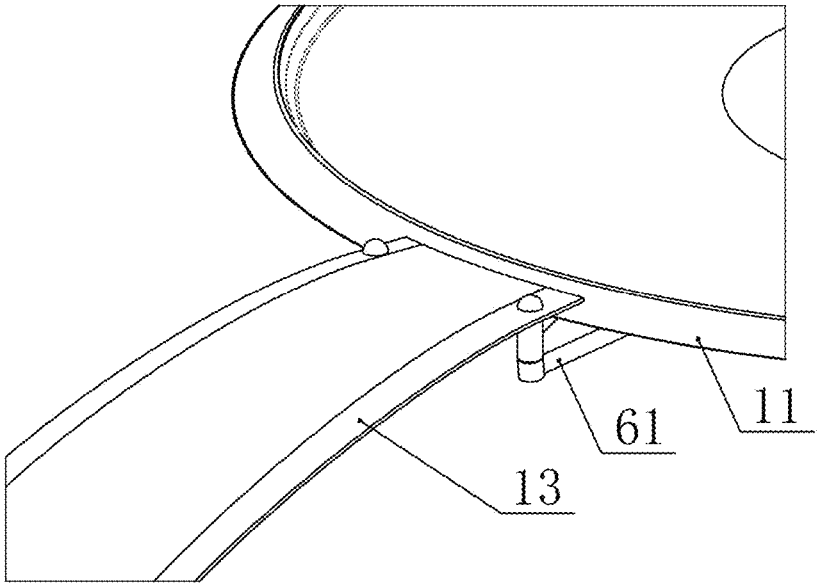
FIG. 5 is a partial structural schematic diagram of the top cap assembled with the fan blades of the present disclosure.

1—cowl body; 11—top cap; 12—bottom ring; 13—fan blade; 2—base; 21—variable-angle pipe neck; 22—waterproof base; 3—screw; 4—upper support; 5—lower support; 6—lifting mechanism; 61—lifting plate; 62—electric pushing rod; 63—lifting shaft; 7—pressure sensor; 8—control box; 9—thermoelectric generator; 901—hot end; 902—cold end; 903—output end; 10—storage battery.

DETAILED DESCRIPTION

The present disclosure is further described below with reference to the accompanying drawings and embodiments, which are not intended to limit the present disclosure.

As shown in FIGS. 1-5, an unpowered cowl with adjustable fan blades of the present disclosure comprises a cowl body 1 and a base 2. The cowl body 1 comprises a top cap 11, a bottom ring 12, and the fan blades 13 closely disposed between the top cap 11 and the bottom ring 12. The top cap 11 and the fan blades 13 are arc-shaped, so that rain is effectively prevented from being accumulated on an outer surface of the cowl body 1. The base 2 comprises a variable-angle pipe neck 21 and a waterproof base 22 fixedly connected to the variable-angle pipe neck 21. A screw 3 and an upper support 4 are disposed in the cowl body 1. A lower support 5 is disposed in the base 2. An upper end of the screw 3 is rotatably connected to the top cap 11. A lower end of the screw 3 passes through a center of the upper support 4. The lower end of the screw 3 is fixedly connected to the lower support 5.

The unpowered cowl further comprises lifting mechanisms 6 and a pressure sensor 7. The pressure sensor 7 is disposed on an inner wall of the top cap 11. An upper end of each of the fan blades 13 is disposed above the top cap 11 and slightly exceeds an outer edge of the top cap 11. A quantity of the lifting mechanisms 6 is corresponding to a quantity of the fan blades 13. The lifting mechanisms 6 are annularly disposed on the top cap 11. The lifting mechanisms comprise lifting plates 61, electric pushing rods 62, and lifting shafts 63. Each of the electric pushing rods 63 and a corresponding one of the lifting shafts 63 are respectively disposed on two ends of each of the lifting plates 61. The electric pushing rods 62 are fixed on the inner wall of the top cap 11. Each of the lifting shafts 63 is connected to a corresponding one of the fan blades 13. The electric pushing rods 62 and the pressure sensor 7 are electrically connected to a control box 8. The control box 8 is disposed on an outer wall of the top cap 11. An angle between each of the lifting shafts 63 and a corresponding one of the lifting plates 61 is 120°. At this time, an angle between each of the lifting shafts 63 and a vertical plane is 20°. When the lifting plates 61 are subjected to downward pressure, the lifting shafts 62 obliquely move upwards.

When in sue, the pressure sensor 7 detects a pressure inside the unpowered cowl and send a pressure value to the control box 8. When the pressure value is greater than a predetermined value (which is determined according to various factors such as floor height), the control box 8 determines that an amount of cooking fumes in a common flue is large, and the control box 8 controls the electric pushing rods 62 to work. Specifically, each of the electric pushing rods 62 pushes a first end of each of the lifting plates 61 to move downwards, so that a second end of each of the lifting plates 61 tilts to drive each of the lifting shafts 63 to move upwards to lift each of the fan blades 13 (when a lower end of each of the fan blades 13 is fixed, each of the lifting shafts 62 obliquely moves upwards to lift an upper end of each of the fan blades 13, and an end portion of the upper end of each of the fan blades 13 contact the top cap 11, and at this time, the height of the fan blades 13 is improved), thereby increasing an opening degree of the fan blades 13 and increasing an exhaust amount of the cooking fumes from the unpowered cowl.

In the embodiment, each of the lifting plates 61 is in a shape of a water drop. A large end of each of the lifting plates 61 is connected to a corresponding one of the electric pushing rods 62, and a small end of each of the lifting plates 61 is connected to a corresponding one of the lifting shafts 63. Therefore, when the electric pushing rods 62 push the lifting plates 61 downwards, the lifting shafts 63 are easier to be driven to move upwards.

In the embodiment, two sides of the upper end of each of the fan blades 13 are connected to two adjacent fan blades 13 through corresponding two of the lifting shafts 63. Therefore, it is ensured that an increased opening degree of each of the fan blades 13 is relatively uniform, so that the cooking fumes are uniformly exhausted from the unpowered cowl. Furthermore, each of the lifting shafts 63 is cylindrical and comprises internal threads. Each of the lifting shafts 63 is connected to a corresponding one of the fan blades 13 through a bolt.

The unpowered cowl further comprises rivets. Two sides of a lower end of each of the fan blades 13 are respectively connected to two adjacent fan blades 13 through corresponding rivets, and the rivets are fixed on the bottom ring 12. Therefore, a structure of the unpowered cowl is simple, and the unpowered cowl is easy to assemble.

In the embodiment, the upper support 4 is fixedly connected to an inner wall of the bottom ring 12 through the rivets; and the lower support 5 is fixedly connected to an inner wall of the variable angle pipe neck 21 through the rivets. Therefore, the unpowered cowl is easy to assemble, and connection firmness is high.

Figure 6:
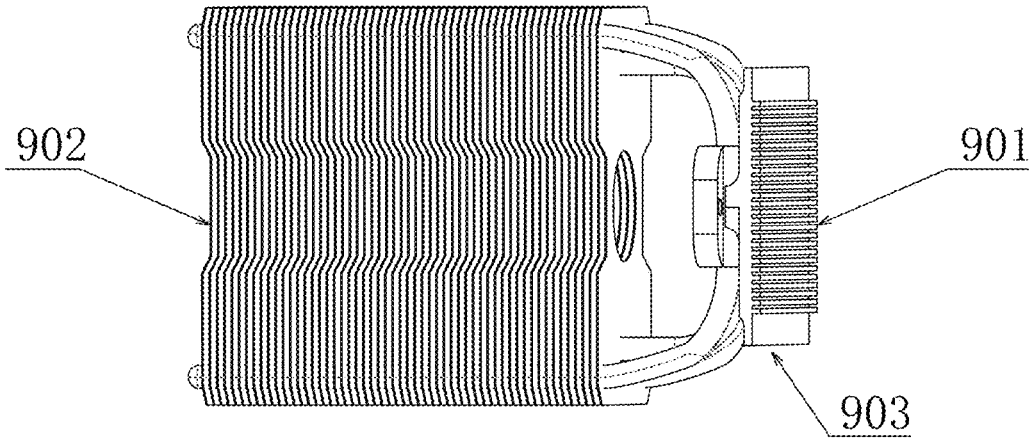
FIG. 6 is a structural schematic diagram of a thermoelectric generator of the present disclosure.
Figure 7:
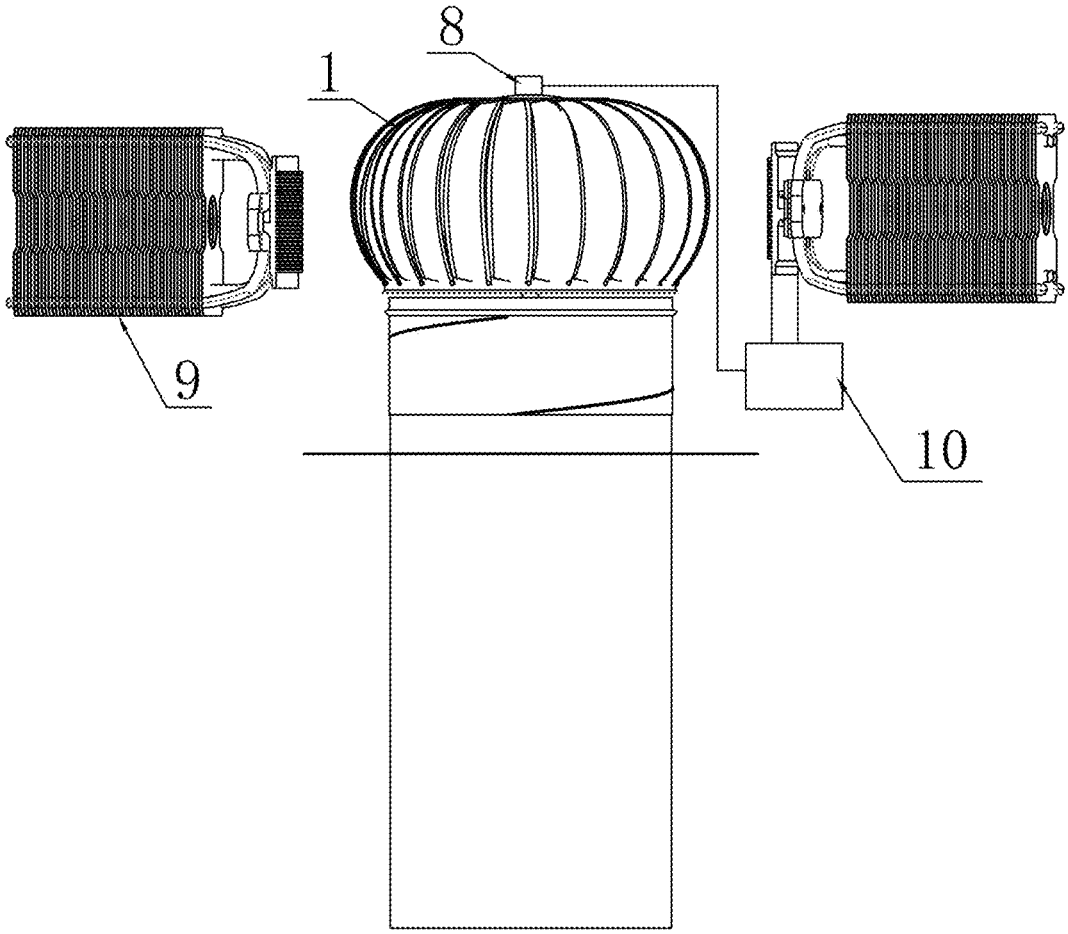
FIG. 7 is a structural schematic diagram of a waste heat recovery system for cooking fumes thermoelectric generator of the present disclosure.
Figure 8:
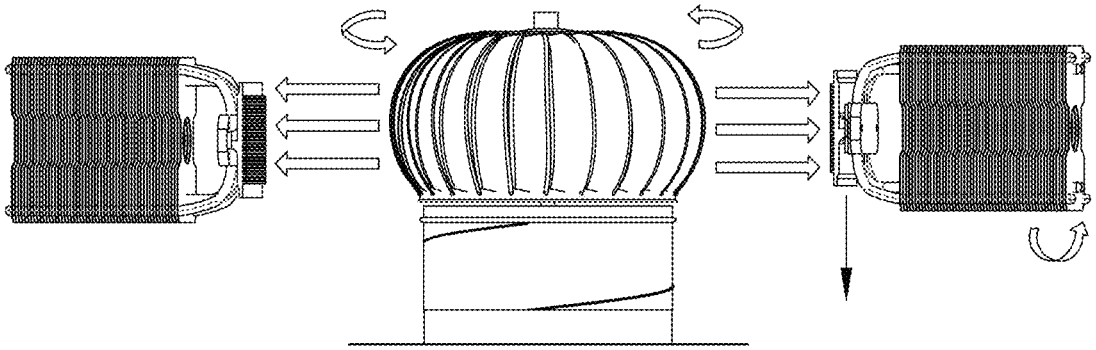
FIG. 8 is a structural schematic diagram showing a flowing direction of cooking fumes in the waste heat recovery system for the cooking fumes shown in FIG. 7.

The present disclosure further provides a waste heat recovery system for cooking fumes as shown in FIGS. 6-8. The waste heat recovery system for the cooking fumes comprises the unpowered cowl mentioned above, a common flue, and thermoelectric generators 9.

The unpowered cowl is disposed at the common flue. The thermoelectric generators are disposed around the unpowered cowl at intervals along a circumferential direction thereof. The thermoelectric generators 9 are rectangular. One end, close to the unpowered cowl, of each of the thermoelectric generators 9 is a hot end 901. One end, away from the unpowered cowl, of each of the thermoelectric generators 9 is a cold end 902. An output end 903 of each of the thermoelectric generators 9 is a lower portion of each of the thermoelectric generators 9. The hot end of each of the thermoelectric generators 9 is disposed opposite to the fan blades 13, and the output end 903 of each of the thermoelectric generators 9 is electrically connected to a storage battery 10.

The thermoelectric generators 9 are configured to absorb and convert waste heat of the cooking fumes in the common flue into the electric energy, and each of the thermoelectric generators 9 outputs the electric energy to the storage battery 10 through the output end thereof. The storage battery 10 is configured to supply power to small devices in a building (for example, various measurement devices, control valves, control switches, sensors, etc.), thereby avoiding energy waste and avoiding use of mains supply.

In one optional embodiment, the control box 8 comprises a controller and a power module. The power module is electrically connected to the controller, the electric pushing rods, and the pressure sensor. The control box 8 is connected to the storage battery 10 through a conductive slip ring. Therefore, the controller, the electric pushing rods 62, and the pressure sensor 7 are directly powered by the electric energy generated by the thermoelectric generators 9 (the electric energy is generated by absorbing the waste heat of the cooking fumes) without providing additional independent power sources. Therefore, an installation structure thereof is simplified, which helps to control costs.

Furthermore, an ultraviolet lamp is disposed on an inner wall of an outlet of the common flue, and the ultraviolet lamp is electrically connected to the storage battery 10. The ultraviolet lamp is configured to disinfect and purify the cooking fumes in the common flue, so that exhausted cooking fumes are more environmentally friendly. After the exhausted cooking fumes not absorbed by the thermoelectric generators 9 are exhausted into atmosphere, environment is not polluted.

Foregoing general description of embodiments involved in the present disclosure and the description of the specific implementations thereof should not be construed as a limitation to technical solutions of the present disclosure. According to the embodiments of the present disclosure, those skilled in the art may add, reduce, or combine technical features disclosed in the general description or/and the specific implementations (including the embodiments) without violating the related components, and form other technical solutions within the protection scope of the present disclosure.

What is claimed is:

1. An unpowered cowl with adjustable fan blades, comprising:

a cowl body; and a base;

wherein the cowl body comprises a top cap, a bottom ring, and the fan blades closely disposed between the top cap and the bottom ring;

wherein the base comprises a variable-angle pipe neck and a waterproof base fixedly connected to the variable-angle pipe neck, a screw and an upper support are disposed in the cowl body, and a lower support is disposed in the base;

wherein an upper end of the screw is rotatably connected to the top cap, a lower end of the screw passes through a center of the upper support, and the lower end of the screw is fixedly connected to the lower support;

wherein the unpowered cowl further comprises lifting mechanisms and a pressure sensor, the pressure sensor is disposed on an inner wall of the top cap, an upper end of each of the fan blades is disposed above the top cap and slightly exceeds an outer edge of the top cap, a quantity of the lifting mechanisms is corresponding to a quantity of the fan blades, and the lifting mechanisms are annularly disposed on the top cap;

wherein the lifting mechanisms comprise lifting plates, electric pushing rods, and lifting shafts, wherein each of the electric pushing rods and a corresponding one of the lifting shafts are respectively disposed on two ends of each of the lifting plates, the electric pushing rods are fixed on the inner wall of the top cap, each of the lifting shafts is connected to a corresponding one of the fan blades, the electric pushing rods and the pressure sensor are electrically connected to a control box, and the control box is disposed on an outer wall of the top cap.

2. The unpowered cowl according to claim 1, wherein an angle between each of the lifting shafts and a corresponding one of the lifting plates is 100°-145°.

3. The unpowered cowl according to claim 1, wherein each of the lifting plates is in a shape of a water drop, a large end of each of the lifting plates is connected to a corresponding one of the electric pushing rods, and a small end of each of the lifting plates is connected to a corresponding one of the lifting shafts.

4. The unpowered cowl according to claim 1, wherein two sides of an upper end of each of the fan blades are connected to two adjacent fan blades through corresponding two of the lifting shafts.

5. The unpowered cowl according to claim 4, wherein the unpowered cowl further comprises rivets, two sides of a lower end of each of the fan blades are respectively connected to two adjacent fan blades through corresponding two of the rivets, and the rivets are fixed on the bottom ring.

6. The unpowered cowl according to claim 4, wherein each of the lifting shafts is cylindrical and comprises internal threads, and each of the lifting shafts is connected to a corresponding one of the fan blades through a bolt.

7. The unpowered cowl according to claim 1, wherein the control box comprises a controller and a power module, and the power module is electrically connected to a solar battery.

8. A waste heat recovery system for cooking fumes, comprising:

the unpowered cowl according to claim 1;

a common flue; and thermoelectric generators;

wherein the unpowered cowl is disposed at the common flue, the thermoelectric generators are disposed around the unpowered cowl at intervals along a circumferential direction thereof, a hot end of each of the thermoelectric generators is disposed opposite to a corresponding one of the fan blades, and an output end of each of the thermoelectric generators is connected to a storage battery.

9. The waste heat recovery system according to claim 8, wherein the control box is connected to the storage battery through a conductive slip ring.

10. The waste heat recovery system according to claim 8, wherein an ultraviolet lamp is disposed on an inner wall of an outlet of the common flue, and the ultraviolet lamp is electrically connected to the storage battery.

* * * * *